United States Patent [19]

Warner et al.

[11] 4,116,206

[45] Sep. 26, 1978

[54] PORTABLE STRUCTURES SR SERIES

[76] Inventors: Kurt Ehrich Warner; Gerhardt Allan Warner, both of 97 Canora St., Winnipeg, Manitoba, Canada

[21] Appl. No.: 739,124

[22] Filed: Nov. 5, 1976 (Under 37 CFR 1.47)

[51] Int. Cl.[2] ..... A45F 1/16

[52] U.S. Cl. ..... 135/4 R; 135/15 PE; 135/15 PQ; 135/DIG. 1; 135/DIG. 9; 403/159

[58] Field of Search ..... 135/4 R, DIG. 1, 15 PE, 135/15 PQ, DIG. 9; 248/278, 281, 500; 403/159

[56] References Cited

U.S. PATENT DOCUMENTS

| | | | |
|---|---|---|---|
| 1,388,478 | 8/1921 | Nelson | 135/DIG. 1 X |
| 1,650,111 | 11/1927 | Byne | 135/4 R |
| 2,051,596 | 8/1936 | Harbaugh | 135/4 R |
| 2,142,851 | 1/1939 | Jolly | 135/DIG. 1 X |
| 2,547,770 | 4/1951 | Pelton | 135/4 R |
| 2,627,865 | 2/1953 | Mitchell et al. | 135/DIG. 1 X |
| 2,797,696 | 2/1957 | Fritsche | 135/DIG. 1 X |
| 3,190,300 | 6/1965 | Wearin | 135/4 R X |
| 3,525,290 | 8/1970 | Pelsue | 135/4 R |
| 3,929,145 | 12/1975 | Schroeder | 135/1 R |

FOREIGN PATENT DOCUMENTS

| | | | |
|---|---|---|---|
| 1,325,748 | 3/1963 | France | 135/4 R |
| 773,113 | 8/1934 | France | 135/4 R |
| 2,140,423 | 2/1973 | Fed. Rep. of Germany | 135/4 R |
| 9,235 of | 1900 | United Kingdom | 135/DIG. 1 |

*Primary Examiner*—Werner H. Schroeder
*Assistant Examiner*—Conrad L. Berman

[57] ABSTRACT

A plurality of arched rib supports is provided with each rib support being pivoted at the upper end or apex thereof so that the lower end portions may move towards one another. A flexible cover is secured to the rib supports and the lower ends are normally mounted upon a common locus so that the shelter can be opened in the form of a partial torus. When it is to be stored and/or transported, the rib supports are folded together to overlap one another, detached from the means pivoting same on a common locus and then the ends are moved towards one another so that they overlap with the gores of the flexible cover being between adjacent hoops. This reduces the overall size of the rib supports, and facilitates handling of the collapsed shelter.

8 Claims, 16 Drawing Figures

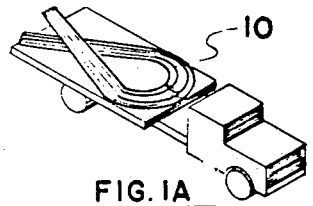
FIG. 1A
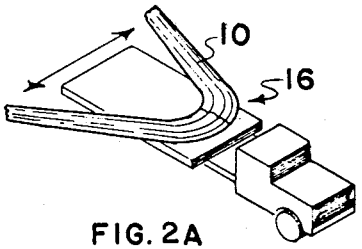
FIG. 2A
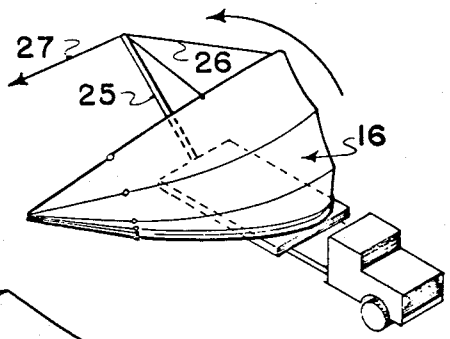
FIG. 3A
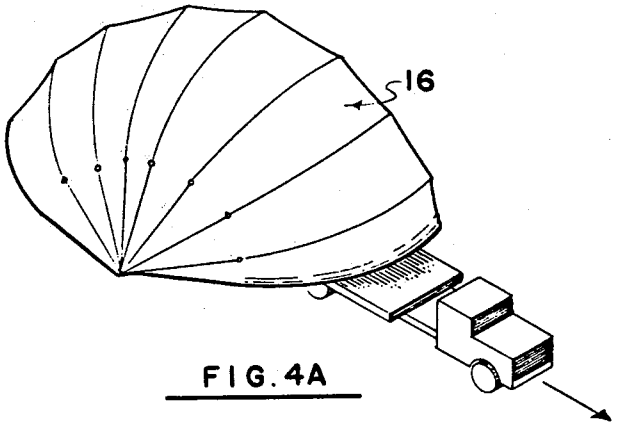
FIG. 4A
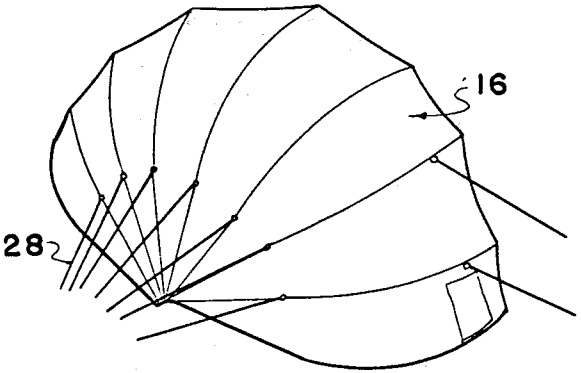
FIG. 5A
FIG. 8
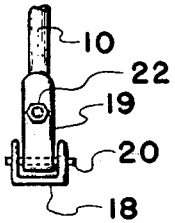
FIG. 9
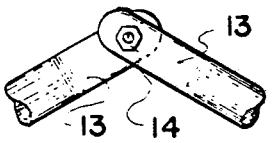
FIG. 10

PORTABLE STRUCTURES SR SERIES

BACKGROUND OF THE INVENTION

This invention relates to new and useful improvements in collapsible shelters, particularly shelters which utilize a multiple arched rib support type configuration having a cover secured thereto and which can be erected and collapsed readily and easily.

While relatively small portable shelters are well known, nevertheless large collapsible shelters have not been available due primarily to the fact that transportation and storage is difficult.

SUMMARY OF THE INVENTION

The present invention overcomes these disadvantages by providing a shelter consisting of a plurality of substantially semi-circular arched rib supports each hinged centrally so that they can fold for transportation and storage purposes with the ends of the rib supports being pivoted on a common locus. A flexible cover is secured to the individual rib supports so that by rotating one rib support, the entire shelter can be erected and thereby provide a stable enclosure or shelter not requiring any internal supports apart from the plurality of rib supports hereinbefore mentioned.

The principal object and essence of the invention is therefore to provide a device of the character herewithin described in which the arched rib supports together with the cover cannot only be collapsed one upon the other but the ends of the rib supports can be moved towards one another so that the transportation and storage is readily accomplished.

Another object of the invention is to provide a device of the character herewithin described in which the shelter is easily erected and removed from a vehicle such as a truck bed.

Yet another object of the invention is to provide a device of the character herewithin described which, in one embodiment, is easily supported by guy ropes from each side.

Another object of the invention is to provide a device of the character herewithin described in which two shelters can be connected together by a central gore thus making a relatively large shelter if desired.

A still further object of the invention is to provide a device of the character herewithin described which is simple in construction, economical in manufacture and otherwise well suited to the purpose for which it is designated.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

FIGS. 1A through 5A show similar views to those illustrated in FIGS. 1 to 5 but illustrating an alternative embodiment.

FIG. 8 is a front elevation of one embodiment of the bottom pivot assembly.

FIG. 9 is an end view of FIG. 8.

FIG. 10 is an enlarged fragmentary front elevation showing one method of pivoting the two portions of the rib support together.

In the drawings like characters of reference indicate corresponding parts in the different figures.

DETAILED DESCRIPTION

Figure 7:
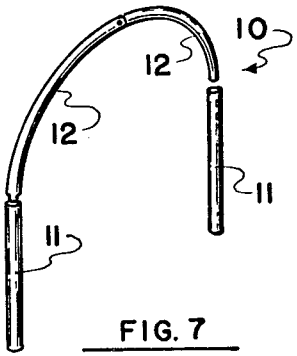
FIG. 7 is an isometric view of one of the rib supports per se.

Proceeding therefore to describe the invention in detail, the plurality of arched rib supports 10 is provided and dealing first with the embodiment shown in FIG. 7, each of these rib supports comprises a pair of straight tube sections 11 with a pair of arcuately curved rib support sections 12 being socketed within the ends of the straight sections and bolted into position or otherwise secured. The other ends of the curved sections 12 are pivoted together at the apex of the rib support as illustrated in FIG. 10 with portions 13 being flattened and in overlapping relationship together with a pivot pin 14 extending therethrough. In this regard, a sock or cover 15 may engage over the pivoted portions to protect same and prevent them damaging the cover of the shelter illustrated by reference character 16.

Figure 7A:
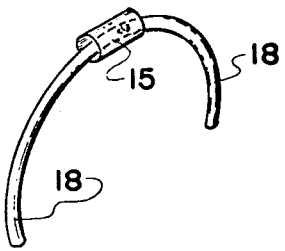
FIG. 7A is an isometric view of an alternative embodiment of the rib support illustrated in FIG. 7.

In the embodiment illustrated in FIG. 7A, two arcuately curved portions of tubing 18 are provided pivoted at the upper end thereof in a manner similar to that illustrated in FIG. 10.

In both embodiments, means are provided in order to hinge the lower ends of the rib supports on a common locus and FIGS. 8 and 9 show one embodiment of such hinging method.

A length of channel 18 is provided with two end plates 19 being pivoted as at 20 one adjacent each end of the channel 18.

A transverse bolt 21 extends through the plates 19 and through the lower ends of the individual rib supports 10 with the bolt being secured in position by means of nuts 22 or similar means.

A central standard 23 extends downwardly through the channel 18 centrally thereof and is secured to any convenient ground anchor 23 thus securing the channel firmly to the supporting surface upon which the shelter is to be erected.

A tube 24 engages the upper end of the standard and the aforementioned cross bolt 21 extends through this tube. The plates 19 are pivoted as at 20 to enable the rib support ends to be engaged over the bolt during assembly.

Dealing first with the erection of the embodiment illustrated in FIGS. 1A through 5A, the cover 16 is manufactured from a flexible fabric and is secured at spaced intervals to the individual rib supports so that it can be extended or retracted with the hoops.

When stored and transported, the rib supports are collapsed one upon the other whereupon the ends are moved inwardly towards one another and overlap as illustrated in FIG. 1A, said overlapping being permitted by the central hinging attachment of the two rib support halves one with the other.

In this position it may be transported to the erecting site whereupon the legs of the rib supports are spread apart as illustrated in FIG. 2A.

A gin pole 25 is secured to the rear of the truck and cables 26 extend from the upper end of this pole to the uppermost rib support as clearly illustrated in FIG. 3A whereupon a hauling cable 27, also secured to the upper end of the pole 25, may be utilized to rotate the rib supports around the pivot points to the position shown in FIG. 4A. By lifting the lowermost rib support, the truck may then be removed and the shelter stabilized by means of guy ropes and rings 28 provided on each side of the shelter. The pivot anchors illustrated in FIG. 8, or equivalent structures, may be secured to the ground or supporting surface upon which the shelter is erected thus making a firm and weatherproof structure unencumbered internally by any vertical or diagonal braces.

In the embodiment illustrated in FIGS. 1 through 6, similar structure is shown with the exception that there are two sets of rib supports, the ends of each set being secured to pivot anchors similar to those illustrated in FIGS. 8 and 9.

Figure 1:
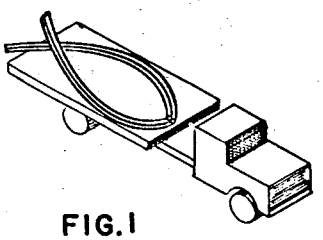
FIG. 1 is an isometric schematic view of one of the shelters upon a truck bed.
Figure 2:
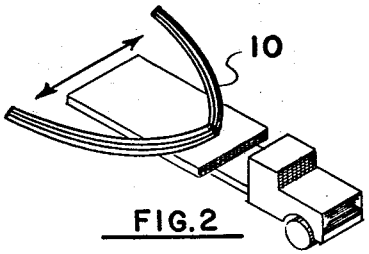
FIG. 2 is an isometric schematic view showing the ends of the rib supports moved outwardly ready for erection.
Figure 3:
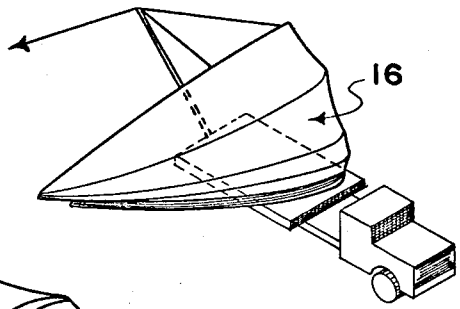
FIG. 3 is an isometric schematic view showing the shelter partially rotated.
Figure 4:
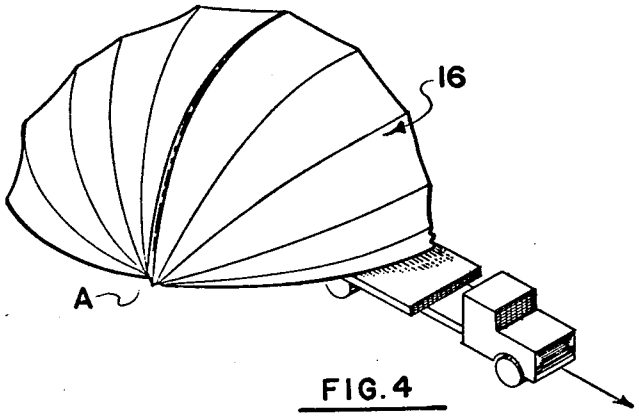
FIG. 4 is an isometric schematic view showing a shelter fully rotated so that the truck can be removed.
Figure 5:
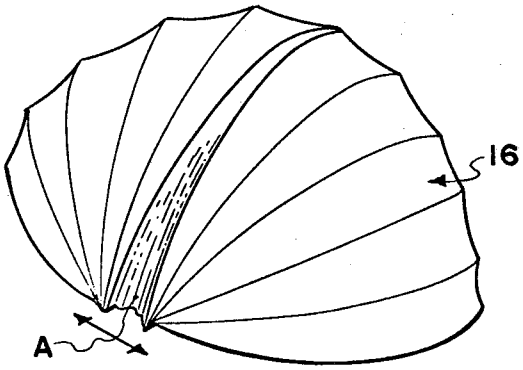
FIG. 5 is an isometric view showing the two portions of the shelter being moved apart.
Figure 6:
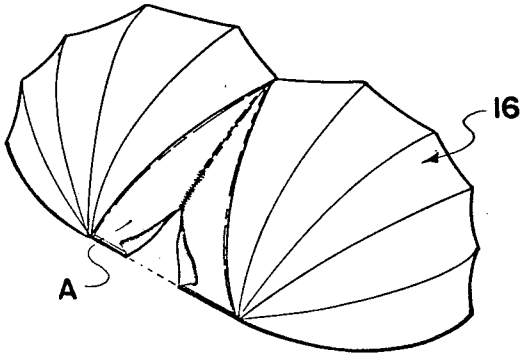
FIG. 6 is an isometric schematic view of the fully errected shelter of this particular embodiment.

Once the shelter has been errected to the stage illustrated in FIG. 4, and the truck removed, the two portions may be moved outwardly to the position shown in FIG. 6 with a triangular gore section 29 joining the two semi sections. A zipper entrance may be provided on either side of this triangular gore as clearly illustrated.

Once again the pivot assemblies are secured to the ground or supporting surface and guy ropes may or may not be required depending upon design parameters.

Since various modifications can be made in our invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What we claim as our invention is:

1. A collapsible shelter comprising in combination two sets of arched rib supports, each of said supports including a pair of lower ends, means to mount said lower ends of each set on an individual substantially common axis for pivotal action of said arched rib supports from a collapsed folded position to an open erected position and vice-versa, a flexible cover secured to and extending over said rib supports, and a flexible substantially triangular gore extending between the adjacent inner ends of the flexible cover, each of said rib supports comprising at least two sections one each extending upwardly from one of said lower ends and being pivotally secured together at the apex of said arched rib support for hinging action whereby, when said rib supports are in the folded collapsed position, the lower ends may be folded inwardly towards one another and overlap one another together with said flexible cover, for storage purposes, said means to mount said lower end portions on a substantially common axis including a mounting channel and an end plate pivoted adjacent each end of said channel, transverse bolt means extending through said end plates and through the lower end portions of said rib supports whereby said rib supports are pivotally mounted upon said bolt means and fastening means for said bolt means.

2. The shelter according to claim 1 which includes means to detachably anchor said channel to the ground.

3. The shelter according to claim 1 in which each of said rib supports is formed in two parts, an upper part and a lower part, and means to detachably secure said parts together.

4. The shelter according to claim 3 which includes means to detachably anchor said channel to the ground.

5. A collapsible shelter comprising in combination a set of arched rib supports, each of said supports including a pair of lower ends, means to mount said lower ends on a substantially common axis for pivotal action of said arched rib supports from a collapsed folded position to an open erected position and vice-versa, and a flexible cover secured to and extending over said rib supports, each of said rib supports comprising at least two sections one each extending upwardly from one of said lower ends and being pivotally secured together at the apex of said arched rib support for hinging action whereby, when said rib supports are in the folded collapsed position, the lower ends may be folded inwardly towards one another and overlap one another together with said flexible cover, for storage purposes, each of said rib supports being formed in two parts, an upper part and a lower part, and means to detachably secure said parts together, said means to mount said lower end portions on a substantially common axis including a mounting channel and an end plate pivoted adjacent each end of said channel, transverse bolt means extending through said end plates and through the lower end portions of said rib supports whereby said rib supports are pivotally mounted upon said bolt means and fastening means for said bolt means.

6. The shelter according to claim 5 which includes means to detachably anchor said channel to the ground.

7. The shelter according to claim 5 which includes two sets of arched rib supports, means to mount the lower ends of each set on an individual substantially common axis for pivotal action, and a flexible substantially triangular gore extending between the adjacent inner ends of the flexible cover.

8. The shelter according to claim 7 which includes means to detachably anchor said channel to the ground.

* * * * *